US005527252A

United States Patent [19]

Sather

[11] Patent Number: 5,527,252

[45] Date of Patent: Jun. 18, 1996

[54] EXERCISE APPARATUS AND METHOD FOR PERFORMING PUSH-UP EXERCISES AND THE LIKE

[76] Inventor: Bradley T. Sather, 4702 Rose Creek Pkwy., Fargo, N. Dak. 58103

[21] Appl. No.: 205,941

[22] Filed: Mar. 3, 1994

[51] Int. Cl.[6] ..... A63B 23/12

[52] U.S. Cl. ..... 482/141; 482/142; 482/131

[58] Field of Search ..... 248/211; 482/141, 482/904, 49, 38–42, 148, 91, 106–108; D21/191, 198; 211/105.1, 123; 4/496, 576.1, 577.1; 182/196, 197, 198, 93; 135/67, 72

[56] References Cited

U.S. PATENT DOCUMENTS

| | | | |
|---|---|---|---|
| 1,189,906 | 3/1961 | Best | 4/576.1 |
| 2,549,506 | 4/1951 | Moore | 4/576.1 |
| 2,551,105 | 5/1951 | Eiden et al. . | |
| 2,642,581 | 6/1953 | Loe | 4/577.1 |
| 2,811,767 | 11/1957 | Dufford . | |
| 3,090,489 | 5/1963 | Smith | 4/496 |
| 4,232,863 | 11/1980 | Roach | 482/141 |
| 4,351,525 | 9/1982 | Rozenblad . | |
| 4,358,106 | 11/1982 | Shadford . | |
| 4,406,450 | 9/1983 | Regan . | |
| 4,621,806 | 11/1986 | Wheeler . | |
| 4,854,573 | 8/1989 | Johannson et al. . | |
| 4,893,363 | 1/1990 | Huff | 4/496 |
| 5,181,897 | 1/1993 | Agan . | |
| 5,306,217 | 4/1994 | Bracone | 4/496 |

FOREIGN PATENT DOCUMENTS

| | | | |
|---|---|---|---|
| 0190990 | 8/1937 | Switzerland | 4/576.1 |

*Primary Examiner*—Jerome Donnelly
*Attorney, Agent, or Firm*—Merchant, Gould, Smith, Edell, Welter & Schmidt

[57] ABSTRACT

An exercise apparatus and method for exercising are disclosed which utilize a conventional staircase to provide varying degrees of inclination during push-up exercises. An exercise apparatus consistent with the invention is specifically adapted for use on a conventional staircase such that it reduces rocking while performing push-up exercises. The level of difficulty of the push-up exercises is varied by placing the exercise apparatus at one of the plurality of elevations along the staircase, thereby allowing different users of different physical capabilities to perform push-up exercises with the same apparatus.

11 Claims, 1 Drawing Sheet

EXERCISE APPARATUS AND METHOD FOR PERFORMING PUSH-UP EXERCISES AND THE LIKE

FIELD OF THE INVENTION

The invention is directed to an exercise apparatus and method of exercising, and more particularly to an exercise apparatus and method for performing inclined push-up exercises and the like.

BACKGROUND OF THE INVENTION

Push-up exercises, wherein a person performs exercises by extending his or her arms outward using the body's weight as the primary resistance, have several therapeutic and other health and fitness benefits. Push-up exercises are particularly suited to increasing strength and benefiting the cardiovascular system.

Several devices have been used to facilitate the performance of push-up exercises. For instance, U.S. Pat. No. 4,351,525 to Rozenblad, U.S. Pat. No. 4,358,106 to Shadford, and U.S. Pat. No. 4,621,806 to Wheeler, disclose various devices for supporting one or more hand grips on a floor or other flat planar surface.

The above devices are somewhat limited in that they place the hand grips a fixed distance from the floor during exercise. Many people, however, are not strong enough to do regular push-ups (i.e., where the hands and the feet are placed roughly along the same plane, the floor). The difficulty of performing a push-up exercise decreases as the angle of the body to the floor increases, for instance, when the hands are inclined relative to the floor and to the feet. It is often beneficial to decrease the level of difficulty of push-up exercises, since many people lack the strength to do standard push-up exercises. This may occur for example because of a previous injury. Alternatively, it may be beneficial to decrease the level of difficulty so that the number of repetitions may be increased, thereby providing a better overall workout.

U.S. Pat. No. 4,854,573 to Johannson discloses an exercise apparatus which has three hand grips having different elevations which are individually selectable to vary the degree of difficulty of push-up exercises. The Johannson device rests on a floor and is rotatable to a plurality of positions. While this device allows for different levels of difficulty, the range of difficulties that may be provided by this device is rather limited unless the device is built to an unduly and inconveniently large size.

U.S. Pat. No. 5,181,897 to Agan provides an exercise apparatus which relies on a non-planar surface other than a floor to enable a user to perform inclined push-up exercises. The Agan device includes angled brackets which are configured to conform to an edge of an object. However, the degree of difficulty which may be selected using this device is dependent upon whatever appropriate surfaces are accessible to a user. In certain circumstances, therefore, the range of difficulty levels which may be selected may be limited. Further, the Agan device is configured to receive an edge of an object in such a manner that the device may rock during normal exercise. Rocking during exercise tends to make the exercise more difficult and less enjoyable, while increasing the risk that the exercise device will become dislodged from the object upon which it is placed, thereby resulting in an injury to the user.

Therefore, a need exists for a device for facilitating the performance of push-up exercises over a wide range of difficulty levels. In particular, a need exists for a device which is capable of securely supporting hand grips at a plurality of elevations so that different types of users and different levels of strength may be accommodated for by a single exercise device.

SUMMARY OF THE INVENTION

It has been found that one type of structure which provides varying levels of elevation for performing push-up exercises and the like is a staircase. Staircases are found in many homes, businesses, and other types of dwellings, and are therefore convenient and readily accessible for many people. The invention addresses the aforementioned and other problems in the prior art by providing an exercise apparatus specifically adaptable for being placed at a plurality of elevations on a staircase, which provides different difficulty levels for performing inclined push-up exercises and the like.

In accordance with one aspect of the invention, there is provided an exercise apparatus configured for use on a staircase of the type having a plurality of steps. The exercise apparatus includes a hand grip and a grip supporting member which is configured to support the hand grip on the staircase. The grip supporting member has first, second and third support surfaces. The first and second support surfaces are configured to support the grip supporting member on foot receiving surfaces of first and second steps in the staircase, respectively. Further, the third support surface is configured to support the grip supporting member in a lateral direction which is generally parallel to the foot receiving surfaces of the first and second steps. In this configuration, the exercise apparatus is configured to abut the staircase in at least three points of contact.

In accordance with another aspect of the invention, there is provided an exercise apparatus for providing a hand hold on a staircase during push-up exercises. The exercise apparatus includes first and second hand grips, first and second support means for supporting the hand grips on first and second steps of the staircase, respectively, and third support means for restricting movement of the hand grips in a direction which is generally parallel to the foot receiving surface of the first step when the first and second support means are supporting the hand grips on the first and second steps, respectively.

In accordance with a further aspect of the invention, there is provided a method for performing push-up exercises with an exercise apparatus of the type which is configured to provide at least one hand hold on a staircase. The method includes the steps of selecting a desired level of difficulty which varies with the placement of the exercise apparatus at a plurality of elevations on the staircase, placing the exercise apparatus at the elevation corresponding to the desired level of difficulty, grasping the hand hold on the exercise apparatus, and performing push-up exercises.

These and other advantages and features, which characterize the invention are pointed out with particularity in the claims annexed hereto and forming a part hereof. However, for a better understanding of the invention and the advantages and objectives obtained by its use, reference should be made to the drawing which forms a further part hereof and to the accompanying descriptive matter, in which there is described a preferred embodiment of the invention.

DETAILED DESCRIPTION OF THE PREFERRED EMBODIMENT

Figure 1:
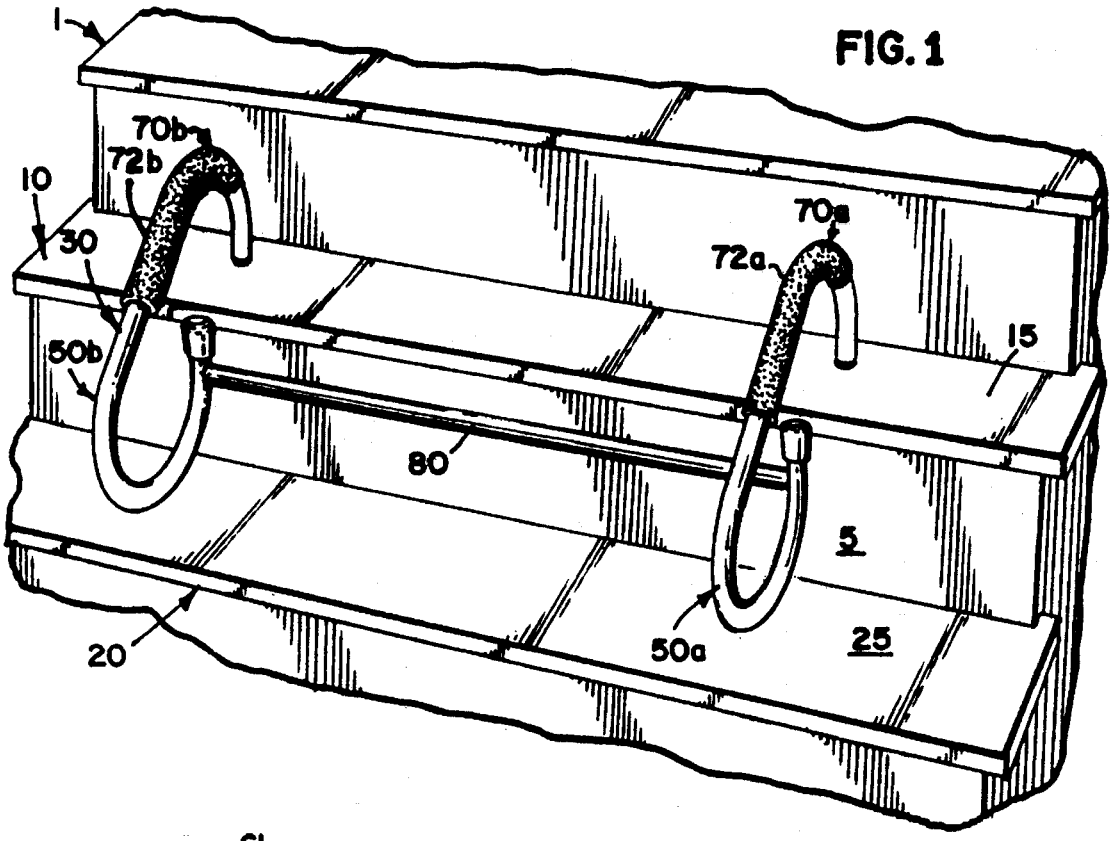
FIG. 1 is a perspective view of a preferred exercise apparatus consistent with the invention, with the exercise apparatus disposed in an operating configuration on a staircase.

Turning to the figures, wherein like numbers denote like parts throughout the several views, FIG. 1 shows a preferred exercise apparatus 30 consistent with the present invention. Exercise apparatus 30 is shown in a normal operational configuration on one of the elevations defined on staircase 1.

The present invention may be used with many types of staircases, that is, pluralities of stairs or steps which are commonly used in many dwellings to connect floors or other surfaces at different elevations. Staircase 1 includes first and second steps 10 and 20 having top surfaces 15 and 25, designated herein as foot receiving surfaces, as these are the surfaces which are stepped upon when walking up or down the staircase. Staircase 1 is shown having connecting surfaces between the various steps, such as connecting surface 5. The surface is generally recessed with respect to a lower step to provide a larger surface area for stepping while reducing the overall size of the staircase.

Exercise apparatus 30 supports one or more hand grips on a staircase to enable a user to perform push-up exercises at varying elevations on the staircase. In particular, exercise apparatus 30 is specifically adapted to conform to the steps of a staircase and thereby reduce the rocking which is associated with some prior devices, regardless of the particular size or shape of the steps.

It will therefore be appreciated that the present invention may be utilized on a wide variety of staircases having a variety of sizes and shapes of steps, as the preferred exercise apparatus does not require a specific size or shape of step in order to be operable. For instance, the preferred exercise apparatus 30 may be utilized on steps constructed of wood or concrete, or steps which are covered with carpet. Exercise apparatus 30 may also be used on steps which lack connecting surfaces between the foot receiving surfaces of the step, such as the type of staircases which are found in many household basements. For these staircases, the edge surfaces of the steps may be used to provide a supporting surface for exercise apparatus 30.

The preferred exercise apparatus 30 includes a pair of oppositely-disposed grip support members 50*a* and 50*b* which support hand grip portions 70*a* and 70*b*, respectively, and which are connected by a cross-brace 80. Grip support member 50*a* is shown in more detail in FIG. 2. In a preferred embodiment, grip support members 50*a* and 50*b* are similarly sized and configured. Therefore, it will be appreciated that the various parts and orientations discussed below in relation to grip support member 50*a* will also be found on the similarly configured grip support member 50*b*.

Grip support members 50*a* and 50*b* are preferably constructed of tubular steel, which is relatively inexpensive, durable, light weight and non-corrosive. It will be appreciated that various alternative materials may be used, such as other metals, plastics, composites, or wood. Further, it will be appreciated that, rather than being a curved tubular member, the grip support members could be formed as solid blocks having support surfaces similar to those defined on the tubular member shown in the figures.

Grip support member 50*a* is preferably bent by a conventional manufacturing process to form first and second generally arcuate members 60*a* and 64*a*. The first arcuate member 60*a* has a first end 61*a* and a second end 62*a*. Likewise, the second arcuate member 64*a* has first end 65*a* and second end 66*a*. Arcuate members 60*a* and 64*a* are joined at their first ends by a first substantially straight, unbent portion 68*a*. Further, it is preferable to include a second substantially straight and unbent portion 69*a* at second end 62*a* of first arcuate portion 60*a*. Straight portion 69*a* is preferably configured to be oriented generally perpendicular to the foot receiving surfaces of the steps when in an operative position.

Figure 2:
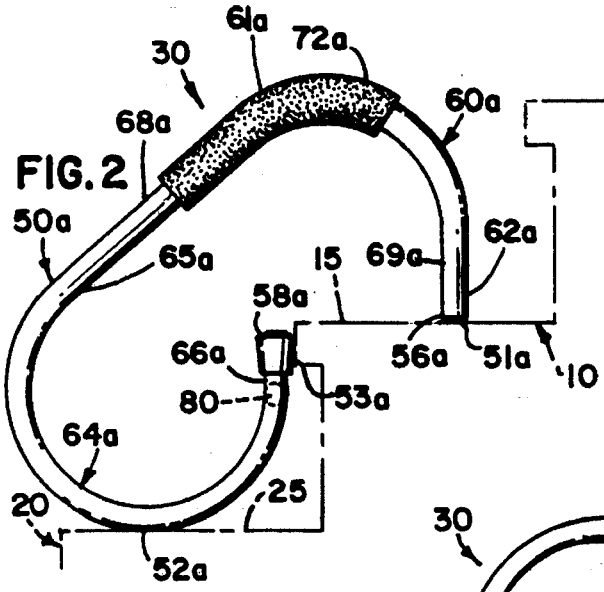
FIG. 2 is a side elevational view of the exercise apparatus of FIG. 1 shown in the operational configuration on a staircase, wherein the staircase is shown in phantom line.

In the configuration shown in FIG. 2, grip support member 50*a* is specifically adapted for supporting the hand grip on a staircase. In particular, grip supporting member 50*a* preferably has three points of contact with the staircase to prevent the exercise apparatus 30 from rocking during push-up exercises.

Grip supporting member 50*a* has a first support surface 51*a* which is configured to support apparatus 30 on the foot receiving surface 15 of the first step 10. This support surface is preferably disposed on the second end 62*a* of arcuate portion 60*a*, or at the end of straight portion 69*a* distal from first arcuate portion 60*a*.

A second support surface 52*a* is also provided on grip supporting member 50*a*. Second support surface 52*a* supports the exercise apparatus 30 on the foot receiving surface 25 of second step 20. This surface is preferably disposed on the convex surface of arcuate portion 64*a*, and is arranged to be generally parallel to first support surface 51*a* such that larger portions of these surfaces will be in contact with the staircase when exercise apparatus 30 is disposed in its operating configuration. This tends to increase the stability of exercise apparatus 30, while reducing the tendency of exercise apparatus 30 to dent, scratch or otherwise mar the surfaces of staircase 1.

A third support surface 53*a* is also provided on grip supporting member 50*a*. While the first and second support surfaces provide the primary support for exercise apparatus 30 on the first and second steps 10, 20, respectively, the third support surface 53*a* provides lateral support for exercise apparatus 30 in order to restrict the movement of the apparatus in a direction which is generally parallel to the foot receiving surfaces 15, 25 of steps 10 and 20. When this surface is disposed in an abutting relationship with staircase 1, the tendency for exercise apparatus 30 to rock during exercising is reduced, since it will be appreciated that during exercise the force applied by a user will have components oriented into the foot receiving surfaces as well as in the lateral direction generally parallel to these surfaces.

It is preferable to configure the third support surface 53*a* on grip supporting member 50*a* such that it abuts a conventional step proximate the edge between a step and a connecting surface, for example near the intersection of foot receiving surface 15 and connecting surface 5. Third support surface 53*a* is preferably disposed on the side of the tubular member, rather than on an end portion thereof, so that the third support surface 53*a* will be able to operatively abut a wide variety of sizes and shapes of steps. While it is preferable to configure third support surface 53*a* to abut staircase 1 proximate the edge between foot receiving surface 15 and connecting surface 5, it will be appreciated that third support surface 53*a* could abut a step at various points on the staircase depending upon the height and shape of the steps.

Figure 3:
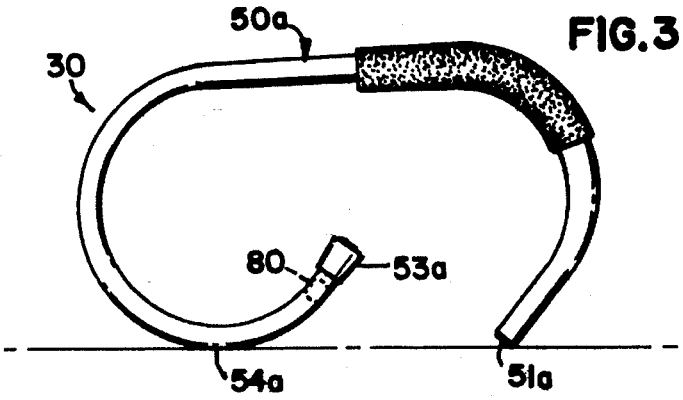
FIG. 3 is a side elevational view of the exercise apparatus of FIG. 1 shown in an alternate configuration on a floor, wherein the surface of the floor is shown in phantom line.

As seen in FIG. 3, grip supporting member 50*a* preferably includes a fourth support surface 54*a* which is disposed on the convex surface of arcuate portion 62*a* between the second and third support surfaces 52*a* and 53*a*. This surface enables exercise apparatus 30 to be used on a floor or other planar surface in addition to a staircase. In this configuration, the maximum level of difficulty is provided by exercise apparatus 30, as it provides the minimum degree of inclination.

It will be appreciated that many alternative designs may be utilized for grip supporting member 50*a*. In particular, it will be appreciated that any shape that is capable of providing at least three points of contact on a staircase, thus providing lateral support in addition to the primary support on the staircase, may be used. For instance, any of the first, second or third support surfaces 51*a*, 52*a* or 53*a* may be disposed on an end portion of a tubular member (such as first support surface 51*a* as shown in FIG. 2), or alternatively may be disposed on the cylindrical surface of a tubular member (such as second and third support surfaces 52*a* and 53*a* as shown in FIG. 2). It would also be feasible to orient a third support surface 53*a* such that it abuts a lower or higher step than is shown in FIG. 2. Grip supporting member 50*a* could also be configured to span more than one step, which would provide additional stability over the adjacent step design disclosed herein.

Returning to FIG. 1, it may be seen that a pair of hand grips 70*a* and 70*b* are formed integrally on grip support members 50*a* and 50*b*, respectively. The hand grips 70*a*, 70*b* are configured to allow for gripping in a natural manner. To this extent, it is preferable to include foam pads 72*a* and 72*b* to provide additional comfort to the hands of a user during push-up exercises. These pads preferably circumscribe the tubular members of the grip supporting members 50*a* and 50*b* and extend at least partially over the first arcuate portion and the straight portion, such as first arcuate member 60*a* and straight member 68*a* shown in FIG. 2. It will be appreciated that different lengths of pads may be used consistent with the invention. It will also be appreciated that different materials and shapes (such as shapes conforming to the shape of a hand, for example) may also be used for pads 72*a* and 72*b*.

While hand grips 70*a* and 70*b* are shown formed integrally on grip supporting members 50*a* and 50*b*, respectively, it will be appreciated that several modifications may be made consistent with the invention. For instance, hand grips may be formed as separate members which are independently supported on grip supporting members 50*a* and 50*b*. Further, hand grips may be oriented in different directions other than parallel to the general plane of the grip supporting members. For instance, hand grips could be provided on a single bar which extends between the grip supporting members 50*a* and 50*b*. Other alternatives include variations to the hand grips for ergonomic concerns, such as modifying the grips to conform better to the shape of the hand and fingers. The hand grips may also be adjustable in order to reorient them for varying elevations (e.g. hinged to the supports). Other alternative hand grip designs will be appreciated by one skilled in the art.

As seen in FIG. 2, end caps 56*a* and 58*a* are also provided on grip supporting member 50*a*. The end caps are preferably constructed of rubber, plastic, or any other non-skid and non-marking material. End cap 56*a* is preferably disposed in the second end 62*a* of first arcuate portion 60*a*, or at the end of straight portion 69*a* distal from first arcuate portion 60*a*. This end cap forms at least part of the first support surface 51*a*, and reduces the movement of exercise apparatus 30 with respect to first step 10 and prevents step 10 from marring or other damage.

End cap 58*a* is preferably disposed in the second end 66*a* of second arcuate portion 64*a*. Further, this end cap extends a distance over the tubular member such that it forms at least part of third support surface 53*a*. Consequently, end cap 58*a* also prevents slippage and/or damage at the point in which third support surface 53*a* abuts staircase 1.

It will be appreciated that an additional non-skid, non-marking cap or surface may be secured to grip supporting member 50*a* to form at least a portion of second support surface 52*a*. This would prevent slippage and/or damage to second step 20, for example.

Returning to FIG. 1, it may be seen that grip supporting members 50*a* and 50*b* are integrally attached by a cross-brace 80 which extends perpendicular to the planes of the grip supporting members. Cross-brace 80 is constructed of tubular aluminum similar to that used for the grip supporting members, or alternatively is constructed of one of the materials which are described above in relation to the grip supporting members. Cross-brace 80 is preferably welded to each of the grip supporting members proximate the second end of the second arcuate portions thereof (e.g., second end 66*a* of second arcuate portion 64*a* on grip supporting member 50*a*). It has been found that this position provides adequate structural stability without interfering with the use of the device. It will be appreciated that other placements of the brace, as well as any additional braces, may also be used consistent with the invention.

Figure 4:
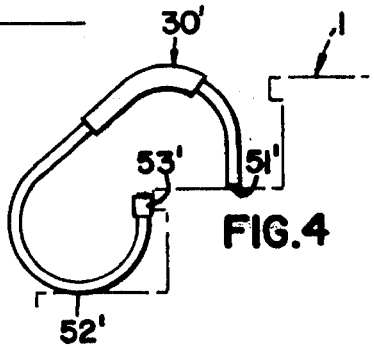
FIG. 4 is a side elevational view of an alternate exercise apparatus consistent with the invention, with a staircase shown in phantom.

It will be appreciated that various other modifications or changes to the structure of exercise apparatus 30 shown in FIGS. 1–3 may be made consistent with the invention. For instance, grid supporting members 50*a* and 50*b* may be constructed of multiple parts, and may extend out of the parallel planes which are generally shown in the figures. Also, the cross-brace may be eliminated, providing individual hand holds which would be separately supported on staircase 1. For example, one of the individual hand holds may take the form of alternate hand hold 30' illustrated on staircase 1 in FIG. 4, having support surfaces 51', 52' and 53'. Further, cross-brace 80 may be adjustable to vary the overall width of exercise apparatus 30 and accommodate for differently sized users. Further, grip supporting members 50*a* and 50*b* may be constructed substantially wider to provide an increased footprint for exercise apparatus 30. Alternatively, a single grip supporting member may be used in lieu of members 50*a* and 50*b*. It will be appreciated that other changes and modifications to the above-described exercise apparatus 30 may be made consistent with the principles of the present invention.

The preferred exercising method of the invention utilizes a staircase as a support for an exercise device to perform inclined push-up exercises. In the method, a level of difficulty is first selected depending on the particular exercise needs of the user. In general, placing an exercise apparatus on higher steps will make the push-up exercises easier due to the increased incline between the body and the horizontal position. As described above, it may be preferable to decrease the level of difficulty due to injury, or to increase the number of repetitions that may be performed before tiring. Later, as one's condition improves, the exercise apparatus may be placed on lower steps to increase the difficulty consistent with the physical conditioning of the user.

Once the desired level of difficulty is selected, an exercise device which is configured to provide at least one hand hold on a staircase is placed in an operating configuration thereof. For instance, an exercise apparatus such as exercise apparatus 30 may be placed in the operating configuration which is described above at the elevation which corresponds to the desired level of difficulty.

The next step in the method is for the user to grasp the handles of the exercise apparatus that is disposed on the staircase. Once the handles are held by the user, the user may then perform the desired number of push-up exercises.

As described above, if one's physical conditioning improves such that placement of the exercise apparatus on the staircase does not provide an adequate work out for the user, the exercise apparatus may then be placed on the floor. In this configuration, the inclination of the body to the floor is minimized, which provides the maximum difficulty for push-up exercises.

The present invention thus provides an exercise apparatus and a method of exercise which utilize a staircase to provide a wide range of difficulty levels in performing push-up exercises. As one skilled in the art will appreciate that various modifications may be made to the preferred embodiments without departing from the spirit and scope of the invention, the invention thus resides in the claims hereafter appended.

I claim:

1. An exercise apparatus configured for use on a staircase of the type having a plurality of steps, comprising:

(a) first and second hand grips;

(b) first and second grip supporting members, the first grip supporting member being configured to support the first hand grip on a staircase and the second grip supporting member being configured to support the second hand grip on the staircase, each grip supporting member having first, second and third support surfaces, the first and second support surfaces of each grip supporting member configured to support the grip supporting member on the foot receiving surfaces of the first and second steps in the staircase, respectively, and the third support surface of each grip supporting member configured to support the grip supporting member in a lateral direction generally parallel to the foot receiving surfaces of the first and second steps; whereby the first and second grip supporting members are each configured to abut the staircase in at least three points of contact; and (c) connecting means for operatively connecting the first and second grip supporting members;

wherein each grip supporting member comprises first and second arcuate members operatively and integrally connected at first ends thereof through a first substantially straight member, wherein the first support surface is disposed proximate a second end of the first arcuate member, wherein the third support surface is disposed proximate a second end of the second arcuate member, and wherein the second support surface is disposed on a generally convex surface of the second arcuate member between the first end and the third support surface.

2. An exercise apparatus configured for use on a staircase of the type having a plurality of steps, comprising:

(a) a hand grip; and (b) a grip supporting member configured to support the hand grip on a staircase, the grip supporting member having first, second and third support surfaces, the first and second support surfaces configured to support the grip supporting member on foot receiving surfaces of first and second steps in the staircase, respectively, and the third support surface configured to support the grip supporting member in a lateral direction generally parallel to the foot receiving surfaces of the first and second steps; whereby the grip supporting member is configured to abut the staircase in at least three points of contact;

wherein the grip supporting member comprises first and second arcuate members operatively connected at first ends thereof, wherein the first support surface is disposed proximate a second end of the first arcuate member, wherein the third support surface is disposed proximate a second end of the second arcuate member, wherein the second support surface is disposed on a generally convex surface of the second arcuate member between the first end and the third support surface, and wherein the hand grip further comprises a first substantially straight member integrally disposed on the grip supporting member between the first ends of the first and second arcuate members.

3. The exercise apparatus of claim 2, further comprising a padded member circumscribing at least a portion of the substantially straight member of the hand grip.

4. The exercise apparatus of claim 2, wherein the grip supporting member further comprises a second substantially straight member integrally connected to the second end of the first arcuate member.

5. The exercise apparatus of claim 4, wherein the first and second arcuate members and the first and second substantially straight members are formed as an unitary tubular member having end caps disposed on first and second ends thereof, wherein the end cap disposed on the first end of the tubular member forms at least a portion of the first support surface, and wherein the end cap disposed on the second end of the tubular member extends over a portion of the second end of the tubular member such that the end cap forms at least a portion of the third support surface.

6. The exercise apparatus of claim 2, wherein the grip supporting member further has a fourth support surface disposed thereon between the second and third support surfaces such that the grip supporting member is configured to support the hand grip on a generally planar surface through the first and fourth support surfaces.

7. The exercise apparatus of claim 2, wherein the first and second support surfaces of the grip supporting member are configured to support the hand grip on adjacent steps in the staircase.

8. An exercise apparatus for providing a hand hold on a staircase during push-up exercises, comprising:

(a) first and second hand grips;

(b) first and second support means for supporting the hand grips on first and second steps in a staircase, respectively; and (c) third support means for restricting movement of the hand grips in a direction generally parallel to a foot receiving surface of the first step when the first and second support means are supporting the hand grips on the first and second steps, respectively, and wherein:

(1) the first and second hand grips are disposed on first and second grip supporting members, respectively, the first and second grip supporting members operatively connected by a cross-brace;

(2) the first support means comprises first support surfaces disposed on the first and second grip supporting members, the second support means comprises second support surfaces disposed on the first and second grip supporting members, and the third support means comprises third support surfaces disposed on the first and second grip supporting members; and (3) each of the first and second grip supporting members comprises first and second arcuate members operatively connected at first ends thereof through a first substantially straight member, and a second substantially straight member operatively connected to a second end of the first arcuate member, the first support surface being disposed on the second substantially straight portion, the third support surface being disposed proximate a second end of the second arcuate member, and the second support surface being disposed on a generally convex surface of the second arcuate member between the first end and the third support surface.

9. The exercise apparatus of claim 8, wherein the first and second hand grips are integrally formed on the first and second grip supporting members, respectively, proximate the first ends of the first and second arcuate members on each of the first and second grip supporting members.

10. The exercise apparatus of claim 8, wherein each of the first and second grip supporting members further has a fourth support surface disposed thereon between the second and third support surfaces such that the grip supporting member is configured to support the hand grip on a generally planar surface through the first and fourth support surfaces.

11. The exercise apparatus of claim 1, wherein the first and second grip supporting members are generally disposed in parallel and offset planes, and wherein the connecting means comprises a cross-brace operatively connected to the first and second grip supporting members and extending generally perpendicular thereto.

* * * * *